US007905161B2

(12) United States Patent
Butler et al.

(10) Patent No.: US 7,905,161 B2
(45) Date of Patent: Mar. 15, 2011

(54) PROCESS OF DRILL BIT MANUFACTURE

(75) Inventors: Drew Mark Butler, Draper, UT (US); Erik M. Gaugh, Park City, UT (US); Todd A. Nevenner, Murray, UT (US)

(73) Assignee: Longyear TM, Inc., South Jordan, UT (US)

( * ) Notice: Subject to any disclaimer, the term of this patent is extended or adjusted under 35 U.S.C. 154(b) by 127 days.

(21) Appl. No.: 12/141,802

(22) Filed: Jun. 18, 2008

(65) Prior Publication Data

US 2008/0314203 A1 Dec. 25, 2008

Related U.S. Application Data

(60) Provisional application No. 60/945,259, filed on Jun. 20, 2007.

(51) Int. Cl.
*B21K 5/04* (2006.01)

(52) U.S. Cl. ..... 76/108.2; 76/108.1

(58) Field of Classification Search ..... 76/108.1, 76/108.2; 266/252, 259
See application file for complete search history.

(56) References Cited

U.S. PATENT DOCUMENTS

| | | | | |
|---|---|---|---|---|
| 3,582,055 | A * | 6/1971 | Winter et al. | 266/132 |
| 4,093,413 | A * | 6/1978 | Schollhorn et al. | 425/110 |
| 4,140,170 | A * | 2/1979 | Baum | 164/493 |
| 4,884,477 | A * | 12/1989 | Smith et al. | 76/108.2 |
| 4,959,089 | A * | 9/1990 | Bhargava et al. | 65/33.4 |
| 5,052,923 | A | 10/1991 | Peter et al. | |
| 5,373,893 | A * | 12/1994 | Eisenmann et al. | 165/65 |
| 5,393,472 | A * | 2/1995 | Shaw | 264/660 |
| 5,402,233 | A | 3/1995 | Schultz et al. | |
| 5,402,994 | A * | 4/1995 | Egger | 266/252 |
| 5,407,180 | A * | 4/1995 | Keil et al. | 266/252 |
| 5,914,088 | A * | 6/1999 | Rao et al. | 266/87 |
| 5,932,508 | A | 8/1999 | Armstrong et al. | |
| 6,073,518 | A * | 6/2000 | Chow et al. | 76/108.2 |
| 6,220,117 | B1 * | 4/2001 | Butcher | 76/108.2 |
| 6,454,030 | B1 * | 9/2002 | Findley et al. | 175/425 |
| 6,523,676 | B1 | 2/2003 | Nakatsukasa et al. | |
| 6,672,367 | B2 * | 1/2004 | Crafton et al. | 164/5 |
| 6,902,635 | B2 * | 6/2005 | Korwin et al. | 148/559 |
| 7,018,584 | B2 * | 3/2006 | Serafini, Jr. | 266/252 |
| 7,204,894 | B1 * | 4/2007 | Chase | 148/601 |
| 7,303,030 | B2 * | 12/2007 | Lockwood et al. | 175/374 |
| 7,338,629 | B2 * | 3/2008 | Crafton et al. | 266/90 |
| 2005/0269751 | A1 * | 12/2005 | Crafton et al. | 266/87 |
| 2007/0102198 | A1 * | 5/2007 | Oxford et al. | 175/374 |

FOREIGN PATENT DOCUMENTS

| | | | |
|---|---|---|---|
| AU | 2008265699 | | 6/2010 |
| JP | 59129718 | A * | 7/1984 |
| KR | 1020060012691 | A | 2/2006 |
| WO | PCT/US2008/067517 | | 12/2008 |

* cited by examiner

*Primary Examiner* — Jason Daniel Prone
*Assistant Examiner* — Jennifer Swinney
(74) *Attorney, Agent, or Firm* — Workman Nydegger

(57) ABSTRACT

A method for making drill bits includes sequentially moving a plurality of drill bits through a belt furnace, and moving the drill bits to a cooling station using an automated device after the drill bits have moved through the belt furnace. A continuous process for making core drill bits may also include placing a drill bit on a belt of a belt furnace, transporting the drill bit through the furnace using the belt, removing the drill bit from the belt using an automated process, and cooling the drill bit.

29 Claims, 2 Drawing Sheets

PROCESS OF DRILL BIT MANUFACTURE

CROSS-REFERENCE TO RELATED APPLICATIONS

This application claims the benefit of U.S. Provisional Patent Application Ser. No. 60/945,259 filed Jun. 20, 2007, which is hereby incorporated by reference in its entirety.

BACKGROUND OF THE INVENTION

1. The Field of the Invention

This application relates generally to methods for manufacturing drill bits, such as continuous manufacturing processes for making diamond-impregnated core drill bits.

2. The Relevant Technology

Often, core drilling processes are used to retrieve a sample of a desired material from below the surface of the earth. An open-faced core drill bit is attached to the bottom or leading edge of a core barrel. The core barrel is attached to a drill string, which is a series of threaded and coupled drill rods that are assembled section by section as the core barrel moves deeper into the formation. The core barrel is rotated and/or pushed into the desired sub-surface formation to obtain a sample of the desired material (often called a core sample). Once the sample is obtained, the core barrel containing the core sample is retrieved by removing (or tripping out) the entire drill string out of the hole that has been drilled (the borehole). Each section of the drill rod must be sequentially removed from the borehole. The core sample can then be removed from the core barrel.

Manufacturing diamond core drill bits is traditionally accomplished using a batch process. In these batch processes, a specific number of drill bits (i.e., 5~6 bits) are prepared and then are manually placed in a box furnace. The drill bits are then heated to temperatures in excess of 2000 degrees Fahrenheit for a pre-determined amount of time until the bits reach the desired state of complete infiltration. The bits are then manually unloaded from the box furnace by an operator. The bits are then cooled and processed. Such batch processes often produce about 6 bits per 35 minutes for a standard bit size.

Such a process often makes use of a fair amount of manual effort. Further, such processes often expose the operator to high temperatures from the bits and the furnace at temperatures over 2000 degrees Fahrenheit, exposing the individual to danger and discomfort. Although protective equipment can make the operation relatively safe, it is an unpleasant and grueling environment for the operator. Additionally, manual batch processes can lead to inconsistencies as they often rely on manual efforts to monitor and move the bits.

Inconsistent product quality, in turn, can lead to lost time during a drilling process because a lower quality bit may become dull in the drilling process more quickly than anticipated. During a drilling process, when a drill bit becomes dull it must be replaced with a new drill bit by tripping out the entire drill string section by section, replacing the old drill bit with the new drill bit, and then the entire drill string must be tripped backed into the borehole section by section. Thus, a drill bit that dulls prematurely may be very costly in time and effort.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A method for making drill bits includes sequentially moving a plurality of drill bits through a belt furnace, and moving the drill bits to a cooling station using an automated device after the drill bits have moved through the belt furnace. A continuous process for making core drill bits may also include placing a drill bit on a belt of a belt furnace, transporting the drill bit through the furnace using the belt, removing the drill bit from the belt using an automated process, and cooling the drill bit.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
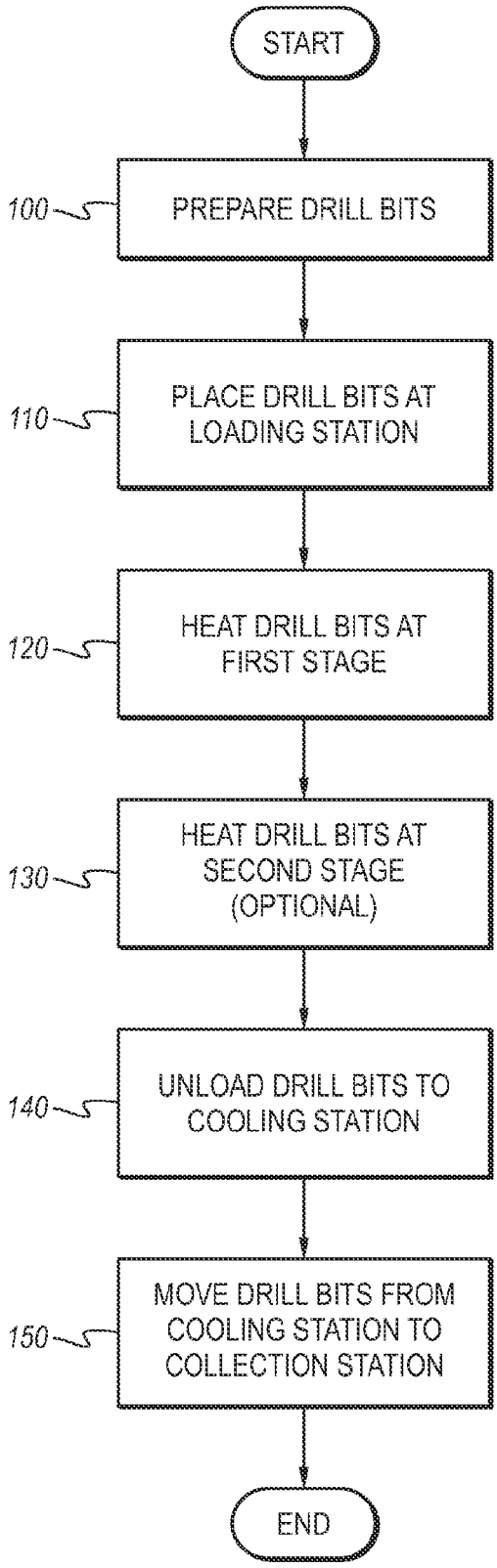
FIG. 1 is a flowchart that illustrates one example of a continuous bit manufacturing process.

A method is provided herein for manufacturing drill bits in a substantially continuous manner. In at least one example, a mold is prepared having molding features defined therein to form cutting features and a body in a finished drill bit, including a crown having cutting features. A mandrel is then introduced to the mold, as well as flux and a mixture of binder material and matrix. The entire drill bit and mold may then be introduced to a heating process as the drill bit is ready. The drill bit will be referenced as moving through the heating process, though it will be appreciated that the drill bit may remain in the mold during the heating process as well as some or all of the subsequent processes described below. The heating process causes the binding material to infiltrate the matrix material and the cutting particles. As the binding material infiltrates the matrix material and the cutting particles, the binding material thereby binds the entire drill bit together.

Heating the drill bit includes moving the drill bit through a furnace or furnaces to heat the drill bit in one or more stages. Further, heat may be applied in varying amounts as the drill bit moves through the heating process. For example, the drill be may be subjected to increasing temperatures as the drill bit progresses through the heating process. An increase in the application of heat relative to location and/or time may be referred to as a gradient or a delta.

In at least one example, the drill bit may be moved through the furnace(s) by placing the drill bit on a moving belt that carries the drill bit through the furnace. Different areas of the furnace may have varying temperatures. As a result, the drill bit may be subjected to a temperature gradient as the belt carries the drill bit through the furnace.

After the drill bit has passed through the furnace, the drill bit may be moved to a cooling station. In at least one example, the drill bit may be moved to a cooling station using a mechanical system, such as a robotic arm. The use of a mechanical system may move an operator from proximity with the furnace and the extreme heat that may be associated therewith. Once the drill bit has cooled sufficiently, the drill bit may be moved to a collection station where the drill bit may be collected for further processing, such as removal of the mold and/or additional finishing processes.

The following description supplies specific details in order to provide a thorough understanding. Nevertheless, the skilled artisan would understand that processes and associated apparatus can be implemented and used without employing these specific details. Indeed, the process and associated apparatus can be placed into practice by modifying the process and associated apparatus and can be used in conjunction with any apparatus, systems, components, and/or techniques conventionally used in the industry. For example, while the description below focuses on a process for making diamond-impregnated coring drill bits, this process may be modified for any core drill bit manufacturing process. Indeed, this process may be implemented in any other drill bit manufacturing process.

FIG. 1 is a flowchart illustrating a method of forming a drill bit according to one example. As illustrated in FIG. 1, the process may begin at step 100 by preparing a drill bit. The drill bit may be prepared in any suitable manner. In at least one example, preparing the drill bit includes forming a mold. The mold is formed from a material that is able to withstand the heat to which the drill bit will be subjected to during a heating process. In at least one example, the mold may be formed from carbon. The mold is shaped to form a drill bit having desired features, such as a crown with cutting features.

Once the mold has been formed, the crown may be formed in the mold. The crown may be formed by mixing cutting particles with a matrix material and a binder material. Further, the cutting materials may be mixed with the matrix material and binder material in such a manner that each of the materials is uniformly distributed through the resulting mixture. Any suitable matrix materials may be used. Matrix materials may include durable materials, including metallic materials such as tungsten carbide. Similarly, any binder materials may be used, including metallic materials such as copper and copper alloys. The cutting materials may include abrasive materials or other materials that are able to cut an intended substrate. Suitable materials may include diamonds, such as synthetic and/or natural diamonds, including powders of the same.

The crown of the drill bit may then be formed by putting the mixture of matrix material and cutting particles into the mold and then pressing the material into the mold. Thereafter, a mandrel may be placed in contact with the mold and with the crown in particular. Additional matrix, binder material and/or flux may then be added to the mold in contact with the crown as well as the mandrel to complete initial preparation of the drill bit.

As illustrated in FIG. 1, once the drill bit is prepared, the drill bit may then be placed at a loading station at step 110. In at least one example, the drill bit (and mold) may be placed at the loading station in any manner, such as manually or by an automated process. The loading station is in communication with one or more heating stages and is configured to move the loading station to a heating process. For example, loading station may include a conveyor belt that moves the drill bit to the heat processing portion.

Accordingly, the process continues by heating the drill bit at a first stage. Heat applied during the first stage may be sufficient to heat various components of the drill bit a desired amount. A drill bit is heated during a first stage by moving the drill bit through a first area that is heated to a desired temperature or temperatures by a first heating element or elements, such as a furnace. The first area may be described as having a length.

The temperature of the first area may vary along its length or the temperature may be substantially constant along the length of the first area. In cases where the temperature varies along the length, the temperature may vary in a stepwise fashion and/or may vary gradually along the length. Further, the speed at which the drill bit moves through the first stage may vary or may be constant. Regardless of the configuration of the heating element, the first heating element subjects the drill bit to heat to heat drill bits during a first stage.

In addition to being heated at a first stage, the drill bits may also be heated in an optional second stage, as illustrated at step 130. The second stage may include a second area heated by a second heating element to a desired temperature or temperatures. The temperature in the second area may be varied about its length or may be held substantially constant. In cases where the temperature in the second area varies along its length, the heat may vary in a stepwise fashion and/or may vary gradually. Further, the rate at which the drill bit moves through the second area may vary or may be substantially constant. The first and the second stages may be performed in the same or different assembly. For example, the first and the second stages may be performed within a single furnace housing using one or more elements and/or may be performed in multiple furnaces. Further, any number of stages may be used having various temperatures at different points or lengths and/or other characteristics. Specific examples will be discussed in more detail below with reference to FIG. 2.

Regardless of the configuration of the heating stage(s), once the drill bit has been heated as desired, at step 140 the drill bits can then be unloaded to one or more cooling station. In one example, the process may be unloaded using an automated device. Automated devices may include any suitable device, such as a robotic picking arm. Further, cooling may be performed using one or more cooling modes using any combination of fluids such as air and/or liquid in combination with pressure as desired.

Once the drill bit has cooled sufficiently, at step 150 the drill bit may be moved from the cooling station to a collection station. From the collection station, drill bits may be further processed as desired, such as to remove the drill bit from the mold and/or to perform additional finishing processes, such as finish machining.

Figure 2:
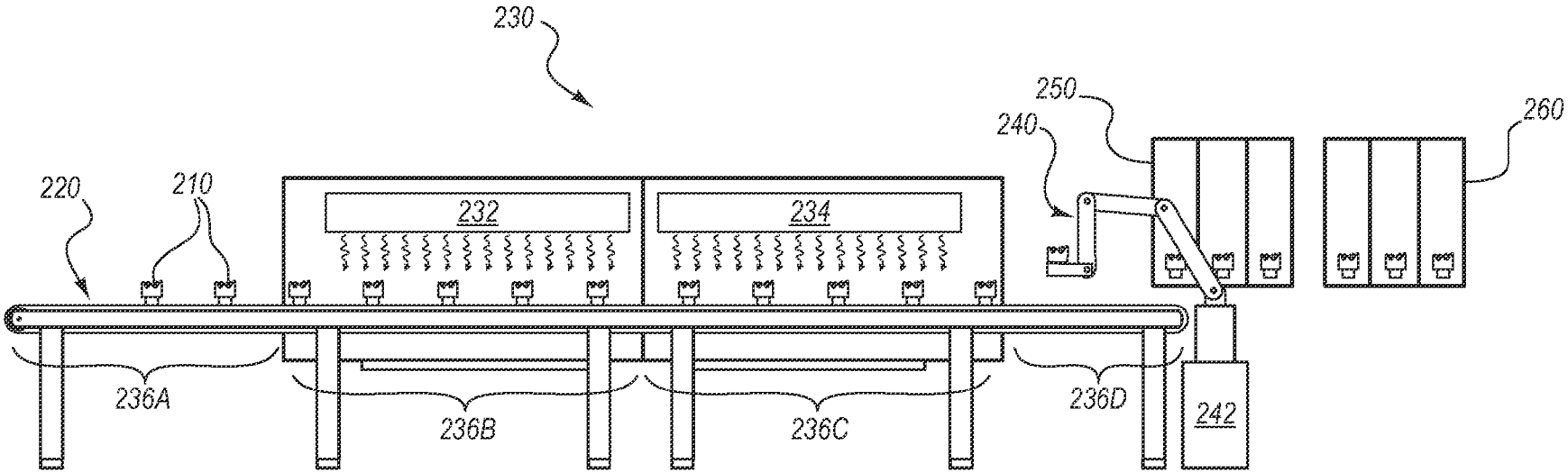
FIG. 2 is a schematic diagram illustrating a system for continuous bit manufacturing according to one example.

One example of a system for performing a continuous process for making drill bits 210 is illustrated schematically in FIG. 2. As shown in FIG. 2, the system generally includes loading station 220, belt furnace 230, unloading station 240, and cooling station 250.

As illustrated in FIG. 2, the drill bits 210 are heat processed by belt furnace 230. In particular, drill bits 210 are individually placed on a belt sections 236A-236D, collectively referred to as belt 236. In particular, the drill bits 210 are placed on belt section 236A at loading station 220. The drill bits 210 may be placed on at any rate or separation desired.

In at least one example, an individual operator can load the drill bits 210 onto belt section 236A at the loading station 220. In other examples, the loading station 220 may include an automatic loader, such as a robotic arm, sorting conveyor, or other mechanized method of loading drill bits 210 onto belt section 236A. For example, drill bits 210 may be supplied to loading station 220 by a conveyor belt (not shown) and then loaded robotically onto belt section 236A at a pre-determined rate. Belt 236A may be one continuous belt, or it may include various sections. Indeed, there can be a plurality of belts moving through the furnace, rather than just a single belt depicted in FIG. 2.

Once drill bits 210 are loaded onto the loading station 220, the belt section 236A may then move the drill bits 210 into belt furnace 230. The belt furnace 230 may include several furnace sections, such as sections 232 and 234 with corresponding belt sections 236B, 236C. Belt section 236A may be operatively associated with belt section 236B in such a manner that a drill bit 210 moving through the system 200 is transferred from belt section 236A to belt section 236B. Belt section 236B may be similarly associated with belt section 236C, which may in turn be similarly associated with belt section 236D.

Further, the system 200 may include any number of belt sections associated with any number of furnace sections. As a result, systems may be provided that include configurations in which a belt section is associated with more than one furnace section and configurations in which one furnace section is associated with more than one belt section. The belt furnace 230 may only have one section, or may have any number of sections for use with any particular process. Further, the sections may be part of a single furnace chamber or may be within different chambers.

In some instances, one or more of the sections may have a relatively small temperature change, otherwise referred to as a delta or gradient, along their length. In these instances, the temperature change (or delta) of the furnace can range from about 10 to about 15 degrees Fahrenheit from a target temperature. Target temperatures may be selected as desired but may be below about 2500 degrees Fahrenheit.

In addition, one or more of the furnace sections 232, 234 may be capable of achieving varying temperatures along their lengths and may be of variable sizes/lengths to achieve and maintain desired temperatures. In some of such instances, a portion of the furnace 230 near an entrance of the first furnace section 232 has a temperature change (or delta) ranging from about −100 to about −500 degrees Fahrenheit from a target. A middle section near the area between the first furnace section 232 and the second furnace section 234 can have a temperature ranging from about −300 to about −100 degrees Fahrenheit from a target. A section near an exit of the second furnace section 234 furnace can have a temperature change from about −100 to about +10 degrees Fahrenheit from a target temperature. Such a configuration subject drill bits 210 to increasing temperatures as the drill bits 210 pass through the furnace 230, which in turn may cause the drill bits to come up to temperature gradually. Such a configuration may allow the drill bit to be heated to a desired temperature while reducing the temperatures within the furnace that are used to do so.

Further, in at least one example, one or more furnace section 232, 234 can be operated in a substantially inert environment. In these embodiments, the gaseous atmosphere in the furnace is constantly refreshed with an inert gas mixture. The inert gas mixture contains an inert gas, or mixture of inert gases, with negligible amounts of air. Examples of inert gases that can be used include N, Ar, noble gases, other gases, and combinations thereof In other examples, a reducing environment may be used. Examples of reducing environments include nitrogen/hydrogen blends, argon/hydrogen blends, and the like.

Each belt section 236A-236D may move at varying rates to allow drill bits 210 to remain in one portion of the belt furnace 230 for longer or shorter periods of time, as desired. For example, in processing diamond-impregnated coring drill bits, the first furnace section 232 may be at a different temperature than the second furnace section 234. Similarly, the first furnace section 232 may be longer or shorter than the second furnace section 234. Once the drill bit 210 exits from belt furnace 230, the drill bit 210 may be removed from belt section 236 at unloading station 240. The unloading station 240 may use an automated unloader 242, such as a robotic arm or other automated machinery such as conveyors, diverters, or any automated device that removes drill bits 210 from belt 236. Unloading station 240 may include sensors to determine the temperature or other states or properties of drill bits 210 to determine when to unload drill bits 210, when to move drill bits 210 for additional processing, or as a quality control check to ensure proper processing of the drill bits 210.

From unloading station 240, drill bits 210 may be cooled in cooling station 250. The drill bits 210 may be moved from the unloading station 240 to the cooling stations 250 by an automated unloader 242. The use of an automated unloader 242 may allow operators to remain away from intense heat associated with the drill bits and the furnace as the drill bits exit the furnace.

Cooling station 250 may include different sections at different temperatures as desired for different types of drill bits. For example, one section of cooling station 250 may include a fan blowing air that is maintained at a particular temperature, and another section of cooling station 250 may include water, or other liquid coolant, for quenching drill bits 210. In some processes, precise cooling temperatures and times may be used to control the formation of particular properties in a finished drill bit. For example, a particular metal alloy can achieve different hardnesses based on the cooling time and temperature.

Cooling station 250 may optionally contain a cooling press that may apply pressure to drill bits 210 to achieve a particular shape or design while they are cooling. In some processes, drill bits 210 may exit belt furnace 230 in a molten, or near molten, state. Thus, a cooling press may be used to provide the final shape of drill bits 210. In other embodiments, cooling station 250 may include additional processing sections that work or otherwise process drill bits 210 at specific temperatures during a cooling process.

Once the drill bits 210 have been cooled as desired, the drill bits may be moved to a collection station 260. The drill bits may be moved to the collection station 260 in any manner, including by the automated unloader 242. From the collection station 260, the drill bits 210 may have any additional processes performed thereon, such as mold removal and/or additional finishing processes.

A manufacturing process using the principles and components discussed above can improve quality and consistency of drill bits 210 over traditional batch processes by automatically controlling and monitoring some or all of the various process conditions described above, including the inert environment, temperature, residence times, and cooling times. Similarly, the efficiency and productivity can also be improved while simultaneously reducing or eliminating the safety concerns.

For example, in at least one specific process, NQ size diamond coring drill bits are manufactured. In this example, drill bits having a matrix of W and using a binder of Cu alloy are made. The drill bits are sequentially loaded on the front end of a belt furnace operating at a temperature of 2000 degrees Fahrenheit. A belt carries the drill bits through the furnace sections so that the average residence time for each drill bit is 30 minutes. As each drill bit exits the end of the furnace, a robotic arm unloads the drill bit and places it in a water circulation cooling press. The drill bit is then cooled at a temperature of about 100 degrees Fahrenheit and a pressure of about 1000 psi. The robotic arm then removes each drill bit from the cooling press after the specified cooling time and moves it to another area to be machined and finished.

The temperature and residence time are monitored and controlled at each section of the furnace to ensure consistency of each drill bits. For NQ size bits, the process produced 1 drill bit about every 1.5 minutes. In contrast, traditional batch processes produce six NQ size drill bits in about 35 minutes, for an average of one drill bit every 7 minutes.

Many types of core drill bits are currently used, including diamond-impregnated core drill bits. This type of drill bit is generally formed of steel or a matrix containing a powdered metal or a hard particulate material, such as tungsten carbide. This material is then infiltrated with a binder, such as a copper alloy. The cutting portion of the drill bit (the crown) is then impregnated with synthetic or natural diamonds. As the drill bit grinds and cuts through various materials, the cutting portion of the drill bit erodes, exposing new layers of the sharp natural or synthetic diamond.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for making drill bits, comprising:

assembling a crown by mixing a plurality of matrix particles, a plurality of cutting particles, and a binder;

positioning a mandrel adjacent the crown;

heating the crown and the mandrel within a belt furnace;

removing the heated crown and the mandrel from the belt furnace and transferring the heated crown and the mandrel to a press while the binder is molten using an automated device;

pressing the heated crown and the mandrel together while the binder is molten; and cooling the crown and the mandrel to form a drill bit.

2. The method of claim 1, wherein a temperature of the belt furnace is substantially continuous along a length of the belt furnace.

3. The method of claim 2, wherein the temperature along the length of the belt furnace varies less than about 15 degrees from a target temperature.

4. The method of claim 1, wherein heating the crown and the mandrel within belt furnace includes moving the crown and the mandrel through a front section having a front temperature, a center section having a center temperature, and an end section having an end temperature, wherein the front temperature varies from between about −100 degrees F. to about −500 degrees F. from a target temperature, the center temperature varies from about −100 degrees F. to about −300 degrees F. from the target temperature, and the end temperature varies from about −100 degrees F. to about +10 degrees F. from the target temperature.

5. The method of claim 4, wherein the target temperature is about 2000 degrees F.

6. The method of claim 1, further comprising introducing inert air to the belt furnace.

7. The method of claim 1, further comprising pressing the mandrel into the heated crown while the binder is molten.

8. The method of claim 7, further comprising placing a mixture of the binder, the plurality of matrix particles, and the plurality of cutting particles in a mold.

9. The method of claim 8, wherein the mold is configured to form a coring drill bit.

10. The method of claim 1, wherein a belt of the belt furnace is configured to move at different rates along different portions of the belt furnace.

11. The method of claim 1, wherein the heated crown is exposed to the atmosphere when removed from the belt furnace.

12. A continuous process for making core drill bits, comprising:

placing a drill bit assembly on a belt of a belt furnace, the drill bit assembly comprising a matrix, a plurality of cutting elements, a binder, and a mandrel;

transporting the drill bit assembly through the belt furnace using the belt, thereby heating the drill bit assembly to a process temperature, wherein the process temperature is at least a temperature high enough to melt the binder;

removing and transferring the heated drill bit assembly from the belt furnace to a press using an automated process while the heated drill bit assembly is at the process temperature; and pressing the heated drill bit assembly while the drill bit assembly is at approximately the process temperature.

13. The process of claim 12, further comprising cooling the pressed drill bit assembly.

14. The process of claim 13, wherein a cooling press is used during the cooling.

15. The process of claim 12, further comprising monitoring the process temperature of the belt furnace.

16. The process of claim 12, wherein the automated process includes a robotic arm.

17. The process of claim 12, wherein an atmosphere within the belt furnace is kept under substantially inert conditions.

18. The process of claim 12, wherein the atmosphere within the belt furnace is kept under a reducing environment.

19. The process of claim 12, wherein the belt furnace comprises at least two furnace sections with each section being maintained at a different temperature.

20. The process of claim 12, wherein any temperature of the belt furnace is less than about 2500 degrees Fahrenheit.

21. The method of claim 12, wherein the drill bit assembly is exposed to the atmosphere when removed from the belt furnace.

22. The method of claim 12, further comprising pressing the heated drill bit assembly within a cooling press.

23. A method of forming drill bits, comprising:

preparing a drill bit assembly comprising tungsten carbide, a copper-based binder, and a blank;

sequentially loading the drill bits assembly on a belt associated with a belt furnace;

sequentially heating the drill bits assembly to a temperature sufficient to bring the binder to a molten state;

sequentially unloading the drill bits assembly from the belt furnace and transferring the drill bit assembly to a press with an automated unloader while the binder is in the molten state; and pressing the drill bit assembly while the binder of the drill bit assembly is in the molten state.

24. The method of claim 23, further comprising cooling the drill bit assembly.

25. The method of claim 24, further comprising cooling the drill bit assembly in a water circulation cooling press.

26. The method of claim 25, wherein said step of cooling the drill bit assembly includes cooling the drill bit assembly with water at a temperature of about 100 degrees F. and in an environment having a pressure of about 1000 p.s.i.

27. The method of claim 23, wherein the belt furnace is operated with a target temperature of about 2000 degrees F.

28. The method of claim 23, wherein the drill bit assembly is exposed to the atmosphere when unloaded from the belt furnace.

29. A method of manufacturing drill bits, comprising:

placing a mixture of a plurality of matrix particles, a plurality of cutting particles, and a binder within an annular mold;

placing an annular mandrel adjacent the mixture;

heating the mixture and the annular mandrel within a belt furnace having an inert or reducing environment;

removing the heated mixture and mandrel from the belt furnace and transferring the heated mixture and mandrel to a press while the binder is molten thereby exposing the heated mixture to the atmosphere; and pressing the mandrel into the heated mixture while the binder is molten.

* * * * *

UNITED STATES PATENT AND TRADEMARK OFFICE

CERTIFICATE OF CORRECTION

PATENT NO. : 7,905,161 B2
APPLICATION NO. : 12/141802
DATED : March 15, 2011
INVENTOR(S) : Butler et al.

It is certified that error appears in the above-identified patent and that said Letters Patent is hereby corrected as shown below:

Column 2
Line 66, change “be may be” to --bit may be--

Column 4
Line 46, change “station” to --stations--

Column 5
Line 56, change “subject” to --subjects--
Lines 62-63, change “section” to --sections--

Column 6
Line 2, change “thereof In” to --thereof. In--

Column 7
Line 18, change “drill bits” to --drill bit--
Line 61, change “within belt furnace” to --within the belt furnace--

Signed and Sealed this
Twenty-third Day of August, 2011

David J. Kappos

David J. Kappos
*Director of the United States Patent and Trademark Office*